US006851206B2

(12) United States Patent
Crawley

(10) Patent No.: US 6,851,206 B2
(45) Date of Patent: Feb. 8, 2005

(54) METHOD AND APPARATUS FOR MINING AND METALLURGICALLY PROCESSING GRANULAR ORE

(76) Inventor: Timothy M. Crawley, 5822 W. Purdue Ave., Glendale, AZ (US) 85302

( * ) Notice: Subject to any disclaimer, the term of this patent is extended or adjusted under 35 U.S.C. 154(b) by 0 days.

(21) Appl. No.: 10/267,169

(22) Filed: Oct. 9, 2002

(65) Prior Publication Data

US 2004/0068894 A1 Apr. 15, 2004

(51) Int. Cl.[7] ..... E02F 3/88
(52) U.S. Cl. ..... 37/317
(58) Field of Search ..... 37/307, 317, 318, 37/322, 323, 195; 299/8, 9, 17; 175/66, 424, 324, 213; 406/88, 96, 153, 157

(56) References Cited

U.S. PATENT DOCUMENTS

| | | | | | |
|---|---|---|---|---|---|
| 4,991,321 | A | * | 2/1991 | Artzberger | 37/309 |
| 5,212,891 | A | * | 5/1993 | Schuermann et al. | 37/323 |
| 5,901,478 | A | * | 5/1999 | Sawyer, Jr. | 37/323 |
| 6,000,151 | A | * | 12/1999 | Hayes | 37/323 |

* cited by examiner

*Primary Examiner*—Robert E. Pezzuto
(74) *Attorney, Agent, or Firm*—Tod R. Nissle, P.C.

(57) ABSTRACT

A method and apparatus for collecting and processing granular material admixes granular material with a fluid to produce a slurry and then removes and processes the slurry. The apparatus enables fluid flowing into the apparatus to be directed substantially simultaneously between a first conduit for admixing granular material with the fluid to produce a slurry and a second conduit for producing suction to remove the slurry.

4 Claims, 2 Drawing Sheets

METHOD AND APPARATUS FOR MINING AND METALLURGICALLY PROCESSING GRANULAR ORE

CROSS REFERENCE TO RELATED APPLICATIONS

N/A

STATEMENT REGARDING FEDERALLY SPONSORED RESEARCH OR DEVELOPMENT

N/A

INCORPORATION-BY REFERENCE OF MATERIAL SUBMITTED ON A COMPACT DISC (See 37 CFR 1.52(e)(5) and MPEP 608.05

N/A

BACKGROUND OF THE INVENTION (1) Field of the Invention

This invention relates to methods and apparatus for collecting and processing granular material and other compositions.

More particularly, the invention relates to a method and apparatus for mining and metallurgically processing granular ore.

In a further respect, the invention relates to a method and apparatus for admixing granular material with a fluid to produce a slurry and for then removing and processing the slurry.

(2) Description of Related Art Including Information Disclosed Under 37 CFR 1.97 and 1.98

Dredge pumps for removing water that has gathered in mine shafts and other low lying areas are known. Since such water often includes suspended or admixed dirt or other debris, dredge pumps are provided with filters or other means to protect the pump impeller from stones, gravel, or other debris contained in the water being removed by the pumps. While in some instances it is preferred to allow as much solid matter as possible to settle from water before the water is removed, in other instances an objective is to remove dirt, gravel, and other material along with the water. Toward this end, it would be highly desirable to provide apparatus which could be used both to produce a slurry mixture of water and solids and to remove the resulting slurry mixture for processing.

Accordingly, it would be highly desirable to provide an improved apparatus that could be used substantially simultaneously to produce a slurry comprised of solids and of at least one fluid and then to remove the resulting slurry mixture for processing.

Therefore, it is a principal object of the invention to provide an improved method and apparatus for removing fluids, slurries, and slurries.

Another object of the invention is to provide an improved method and apparatus for substantially simultaneously producing a slurry and removing the slurry.

A further object of the invention is to provide an improved method and apparatus for removing granular ore from bodies of water and for processing the granular ore to separate metal-rich particles from the ore.

BRIEF DESCRIPTION OF THE SEVERAL VIEWS OF THE DRAWING(S)

These and other, further and more specific objects and advantages of the invention will be apparent to those of skill in the art from the following detailed description thereof, taken in conjunction with the drawings, in which.

BRIEF DESCRIPTION OF THE INVENTION

Briefly, in accordance with the invention, I provide an improved method for mining and metallurgically processing granular ore in a body of water. The method includes the step of providing hydraulic variable valve apparatus. The apparatus includes a body; a nozzle connected to the body; a feed conduit to direct pressurized fluid into the body to suction granular ore into the nozzle; an admixing conduit adjacent the nozzle to discharge pressurized fluid into granular ore to intermix the ore with the fluid; a valve moveable between at least two operative positions, a first operative position for directing pressurized fluid into the admixing conduit, and a second operative position for directing pressurized fluid into the feed conduit; and, a pump operable to direct pressurized water to the valve for direction to either the feed conduit or the admixing conduit. The method also includes the steps of operating the pump to direct pressurized water to the valve; positioning the nozzle adjacent granular ore in the body of water; moving the valve to the first operative position to admix the granular ore with water to produce an ore—water slurry; and, moving the valve to the second operative position to suction the ore—water slurry.

DETAILED DESCRIPTION OF THE INVENTION

Figure 2:
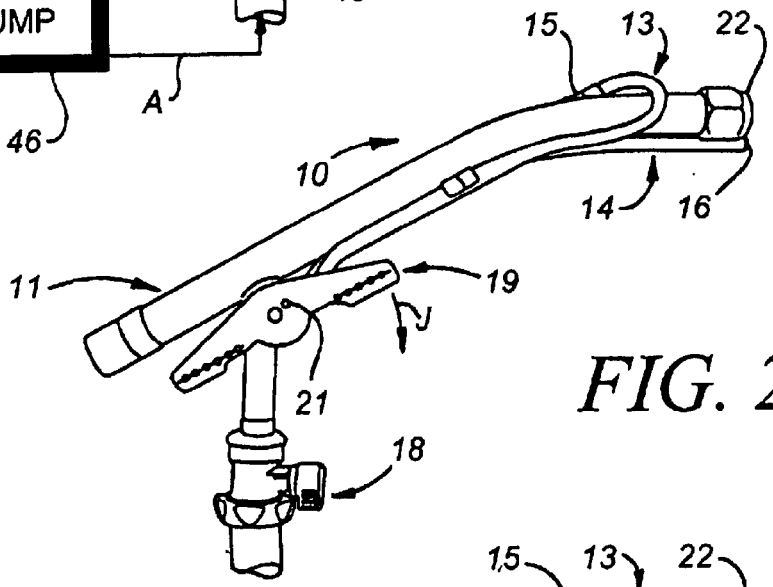
FIG. 2 is a side elevation view of the apparatus of FIG. 1 further illustrating the mode of operation thereof.
Figure 3:
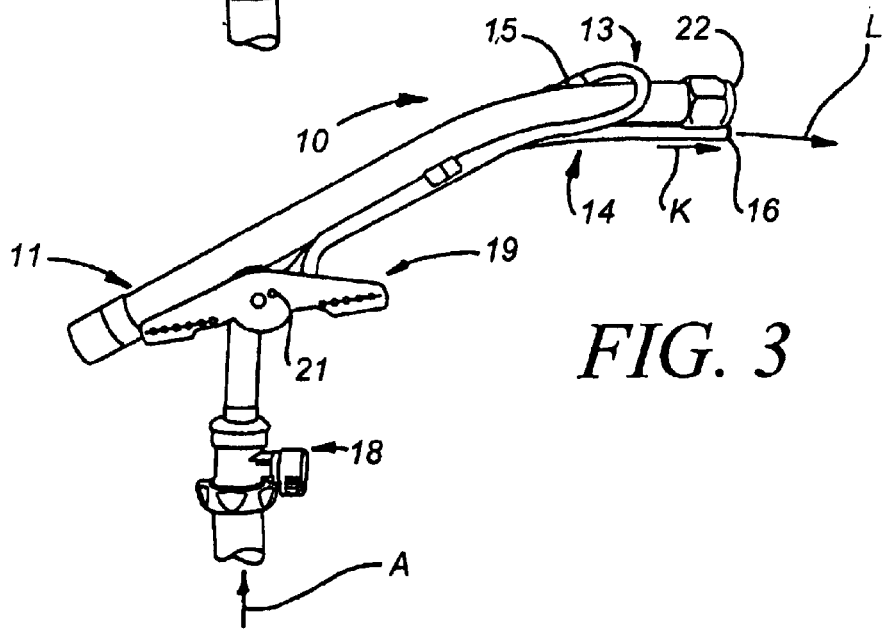
FIG. 3 is a side elevation view of the apparatus of FIG. 1 further illustrating the mode of operation thereof.
Figure 4:
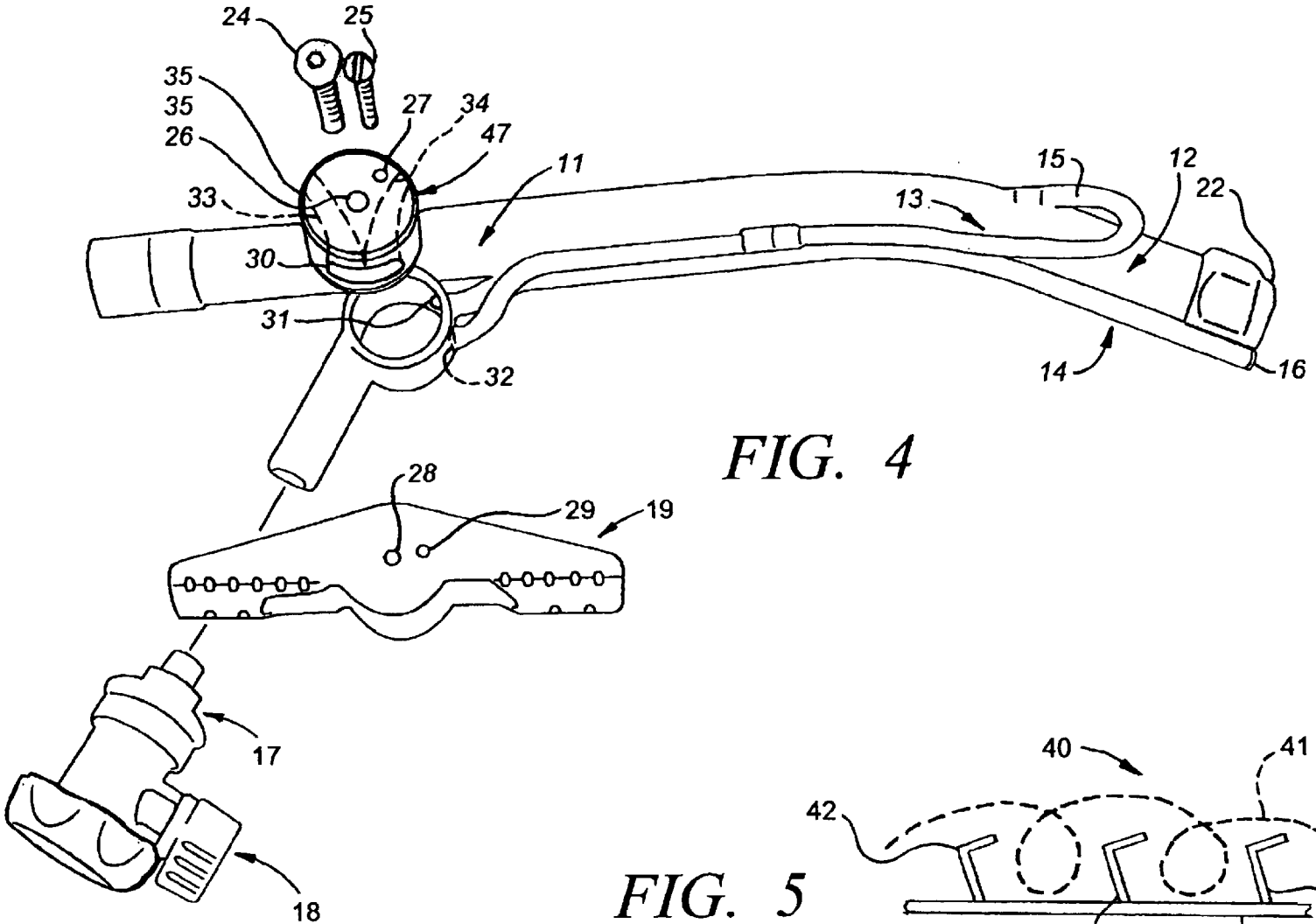
FIG. 4 is an exploded assembly view of the apparatus of FIG. 1 illustrating further construction details thereof; and, FIG. 5 is a side elevation view illustrating a portion of a sluice and the riffle thereof used in processing granular ore in accordance with the invention.

Turning now the drawings, which depict the presently preferred embodiments of the invention for the purpose of illustration thereof, and not by way of limitation of the invention, and in which like characters refer to corresponding elements throughout the several views, FIGS. 1 to 4 illustrate mining apparatus constructed in accordance with the invention and generally indicated by reference character 10. Mining apparatus 10 includes body 11, nozzle 12, feed conduit 13, admixing conduit 14, conduit 45, hollow fitting 17 securing conduit 45 to body 11 in fluid communication with body 11, and lever 19 for operating a variable valve. The variable valve permits fluid outflow through at least two different conduits or paths. The valve includes cylindrical member 47 rotatably housed in hollow cylindrical sleeve 48 (FIG. 4). Fitting 17 includes valve 18 for controlling the flow of fluid through fitting 17 to the valve. Screws 24 and 25 secure lever 19 to member 47 such that displacing lever 19 causes member 47 to rotate simultaneously with lever 19. When member 47 rotates, it slidably rotates in fixed sleeve 48.

Member 47 includes channels 33 and 34 formed therethrough. When lever 19 is in the neutral position illustrated in FIG. 2, outer portion 35 of member 47 extends over openings 31 and 32 formed in sleeve 48, and, channel 33 is not aligned with opening 31 or 32 and channel 34 is not aligned with opening 31 or 32. When lever 19 is in the neutral position, fluid from conduit 45 does not flow through fitting 17 into either conduit 13 or conduit 14.

Figure 1:
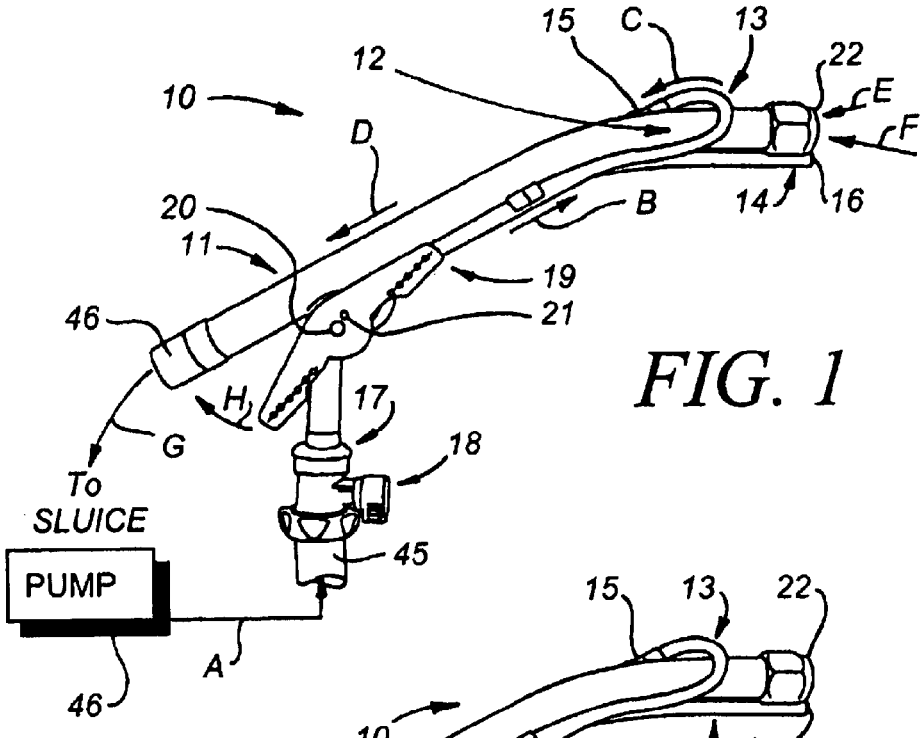
FIG. 1 is a side elevation view illustrating apparatus constructed in accordance with the invention to remove fluids, slurries, and solid particulate and illustrating the mode of operation thereof.

When lever 19 is in the position illustrated in FIG. 1, portion 35 covers opening 31, and channel 34 is aligned with opening 32. This permits pressurized fluid to flow through fitting 17 and channel 34 into feed conduit 13. Pressurized fluid flowing in the direction of arrow B through feed conduit 13 flows through end 15 of conduit 13 in the direction of arrow C into body 11, creating a suction that draws fluids, slurries, powders, etc. into the opening or mouth at the end 22 of hollow nozzle 12 (and henceforth into body 11 and conduit 46) in the directions indicated by arrows E and F. Pressurized fluid and the material drawn into nozzle end 22 flow through body 11 in the direction of arrow D and into conduit 46. Conduit 46 transports the pressurized fluid and material drawn into the opening at the nozzle end 22 to a sluice or other equipment for metallurgically or otherwise processing the fluid and material.

When lever 19 is in the position illustrated in FIG. 3, portion 35 covers opening 32 , and channel 33 is aligned with opening 31. This permits pressurized fluid to flow through fitting 17 and channel 34 into admixing conduit 14. Pressurized fluid flowing through admixing conduit 14 in the direction of arrow K exits through end 16 of conduit 14 in the direction of travel indicated by arrow L.

Lever 19 is pivoted between the three operative positions shown in FIGS. 1 to 3. For example, pivoting lever 19 a short distance in the manner indicated by arrow H in FIG. 1 will move lever 19 to the neutral position shown in FIG. 2. Pivoting lever 19 in the manner indicated by arrow J in FIG. 2 will moved the lever to the position shown in FIG. 3. As would be appreciated by those of skill in the art, fitting 17 or body 11 can be held with one hand and one of the fingers of the hand used to operate lever 19 to quickly move lever 19 between the three operative positions illustrated in FIGS. 1 to 3.

Figure 5:
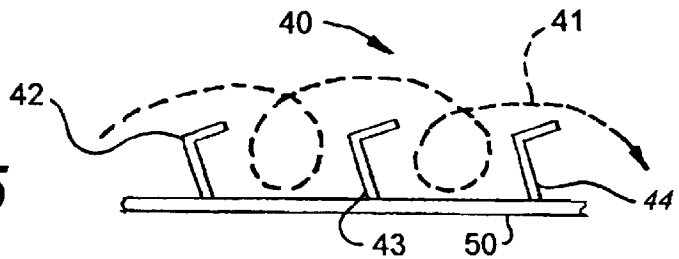

In use, a source of fluid and/or solids is selected. By way of example, and not limitation, the source could comprise a pond of water, could comprise air bearing small gold particles, could comprise a powder, could comprise a mixture of water and particulate suspended in the particulate, or could comprise a mixture of alcohol and suspended particulate. However, for purpose of the following discussion, it is assumed that the source of fluid and solids comprises a stream having a bed comprised of sand and other small stones or particulate. Conduit 46 is connected to a sluice of the type used to metallurgically separate out heavier particles from ore. The sluice 40 includes riffles 42 to 44. As water travels down the sluice, the desired path of travel of the water is indicated by dashed line 41 in FIG. 5. This path of travel ordinarily causes heavier particles, for example gold bearing particles, to be deposited on bottom 50 at the base of riffles 42 to 44. Conduit 46 can be connected to any other desired processing equipment, or can simply lead to an area where the material traveling through conduit 46 is stored or discarded.

Lever 19 is moved to the neutral position illustrated in FIG. 2. Pump 46 is activated. Pump 46 can be powered by battery or any other desired means. Pump 46 can be placed directly in the stream, or, a hose can interconnect pump 46 and the stream and direct water from the stream to the pump. Pump 46 directs water (or air or some other fluid or fluids) into conduit 45 in the direction of arrow A. The water passes through fitting 17 and through opening 30 into valve member 47. Since, however channels 33, 34 are not aligned with either opening 31 or 32, the pressurized water can not flow into either conduit 13, 14.

Nozzle 12 is placed into the stream adjacent the sand or other particulate at the bottom of the stream. Lever 19 is manually displaced to the position shown in FIG. 3 so that pressurized water travels through channel 34 into conduit 14 and exits end 16 of conduit 14 in the direction of arrow L. Pressurized water exiting end 16 disturbs the sand and intermixes it with water from the stream and with water exiting end 16, producing a water—particulate slurry. Lever 19 is then manually displaced from the neutral position shown in FIG. 3 to the position shown in FIG. 1. This halts the travel of water through channel 34 and conduit 14 and, instead, permits water (or another desired fluid or fluids) to flow through channel 33 and into conduit 13. Water flowing through conduit 13 exits through end 15 into body 11, creating a suction that draws the water particulate slurry into the open end 22 of nozzle 12 and into and through body 11 into conduit 46 in the directions indicated by arrows E, F, D. The ability to manually displace lever 19 to divert the flow of water under pressure from conduit 14 to conduit 13 (or vice-versa) allows substantially simultaneous operation of each of the conduits. Water can be diverted from one conduit to the other in less than a second. In one embodiment of the invention, the valve is adapted so that a portion of the pressurized water from conduit 45 flows through conduit 13 while, at the same time, the remaining portion of the pressurized water flows through conduit 14.

Water flowing through conduit 46 in the direction of arrow G travels to sluice 40. The heavier particles are separated from the remaining particles in sluice 40. The heavier particles desirably include or are comprised of gold or another desired material.

Having described the presently preferred embodiments and best mode of the invention in such terms as to enable those of skill in the art to understand and practice the invention, I claim:

1. A method for mining and metallurgically processing granular ore in a body of water, comprising the steps of (a) providing hydraulic variable valve apparatus including (i) a body having an exterior and a hollow interior suctioning channel, (ii) a nozzle connected to said body, (iii) a feed conduit extending adjacent and along said exterior and outside of said hollow interior suctioning channel to direct pressurized fluid into said hollow interior suctioning channel of said body to suction granular ore into said nozzle, (iv) an admixing conduit extending adjacent and along said exterior and outside of said hollow interior suctioning channel and having an end adjacent said nozzle to discharge pressurized fluid into granular ore to intermix said ore with said fluid, (v) a valve moveable between at least two operative positions, (i) a first operative position for directing pressurized fluid through a first open channel in said valve and into said admixing conduit, and (ii) a second operative position for directing pressurized fluid through a second open channel in said valve and into said feed conduit, (vi) a pump operable to direct pressurized water to said valve for direction by said valve to either said feed conduit or said admixing conduit;

(b) operating said pump to direct pressurized water to said valve;

(c) positioning said nozzle adjacent granular ore in the body of water;

(d) moving said valve to said first operative position to direct water through said first open channel, along said admixing conduit on said exterior of said body, and out said end of said admixing conduit to admix the granular ore with water to produce an ore—water slurry; and, (e) moving said valve to said second operative position to direct water through said second open channel, along said feed conduit on said exterior of said body, and from said feed conduit into said hollow interior suctioning channel to suction said ore—water slurry into said hollow interior suctioning channel.

2. The method of claim 1 wherein said first and second channels in said valve generally extend completely through said valve and are substantially free of obstructions to facilitate the flow of water therethrough in steps (d) and (e).

3. The method of claim 1 wherein (a) said valve includes a rotatable unitary member in which said first and second channels are formed;

(b) said unitary member is in a first orientation when said valve is in said first operative position in step (d); and, (c) said unitary member rotates from said first orientation to a second orientation when said valve is moved in step (e) from said first to said second operative position.

4. The method of claim 1 wherein said feed conduit, said admixing conduit, and said valve are connected to said body to facilitate control of said hydraulic variable valve apparatus.

* * * * *